US007472657B2

(12) United States Patent
Hanson et al.

(10) Patent No.: US 7,472,657 B2
(45) Date of Patent: Jan. 6, 2009

(54) APPARATUS FOR REDUCING $NO_X$ EMISSIONS IN FURNACES THROUGH THE CONCENTRATION OF SOLID FUEL AS COMPARED TO AIR

(75) Inventors: Simon P. Hanson, Venetia, PA (US); Murray F. Abbott, Upper St. Clair, PA (US)

(73) Assignee: Fuel and Furnace Consulting, Inc., Venetia, PA (US)

( * ) Notice: Subject to any disclaimer, the term of this patent is extended or adjusted under 35 U.S.C. 154(b) by 324 days.

(21) Appl. No.: 11/383,245

(22) Filed: May 15, 2006

(65) Prior Publication Data

US 2006/0260521 A1 Nov. 23, 2006

Related U.S. Application Data

(60) Provisional application No. 60/682,573, filed on May 19, 2005.

(51) Int. Cl.
*F23C 1/10* (2006.01)

(52) U.S. Cl. ..... 110/261; 110/310; 110/313

(58) Field of Classification Search ..... 110/347, 110/104 B, 309, 310, 313, 261–265; 431/181, 431/182, 183, 187, 6, 11, 207, 208, 240, 431/241, 67; 266/182, 267
See application file for complete search history.

(56) References Cited

U.S. PATENT DOCUMENTS 1,967,673 A * 7/1934 Kennedy ..... 110/104 B
4,147,116 A 4/1979 Graybill
4,265,648 A 5/1981 Wedege
4,333,405 A * 6/1982 Michelfelder et al. ..... 110/264
5,042,400 A 8/1991 Shiraha et al.
5,765,488 A 6/1998 Vatsky
5,878,700 A 3/1999 Farzan et al.
5,967,061 A 10/1999 Ashworth et al.
6,155,183 A * 12/2000 Vierstra et al. ..... 110/345
6,280,695 B1 8/2001 Lissianski
6,319,458 B1 11/2001 Jung et al.

FOREIGN PATENT DOCUMENTS

EP 01517085 A2 3/2005
JP 59027107 * 2/1984
WO WO 2004007351 A2 1/2004

* cited by examiner

*Primary Examiner*—Kenneth B Rinehart
(74) *Attorney, Agent, or Firm*—McKay & Associates

(57) ABSTRACT

A device for optimizing coal-air proportions entering a furnace is disclosed. The invention generally comprises a burner nozzle having two ends and an outer tube forming a perimeter of the burner nozzle; an entry spool having a rear wall and defining an inlet port at one of the ends of the burner nozzle; an inner tube formed within the burner nozzle; an annular blade chamber defined between the outer tube and the inner tube; and, a blade formed within the blade chamber configured as an extension of the rear wall of the entry spool, the blade twisted to form a spiral around the inner tube, wherein fuel particles can be separated from a primary air stream and collected on the blade to form a coal-concentrated stream for entry into the furnace. As a result, three separate streams are injected into the furnace, thereby minimizing NOx through the concentration of solid fuel.

8 Claims, 16 Drawing Sheets

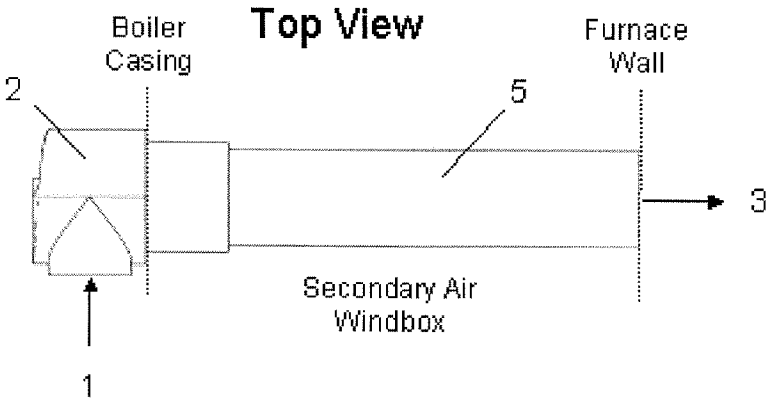
Figure 13
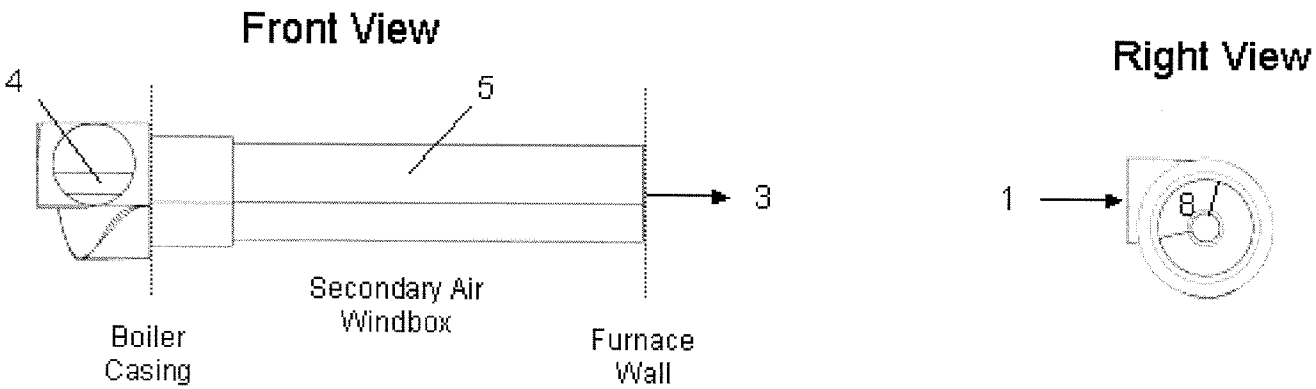
Figure 14
Figure 15

*Flow direction at burner exit is perpendicular to page towards Reader with minimal rotation in plane of page.

APPARATUS FOR REDUCING $NO_X$ EMISSIONS IN FURNACES THROUGH THE CONCENTRATION OF SOLID FUEL AS COMPARED TO AIR

SPECIFIC REFERENCE

This invention hereby claims priority to provisional application Ser. No. 60/682,573 filed on May 19, 2005.

BACKGROUND

The present invention relates to furnaces in applications where $NO_x$ emissions must be minimized. This is particularly important in electric utility power generation applications, which are highly regulated by environmental authorities.

An important example of this technology is pulverized-coal burning furnaces. Disclosed herein is an apparatus for dramatically improving the $NO_x$ emission characteristics of these furnaces by the concentration of fuel and the subsequent reduction of air proportions available at various stages of the combustion process. The present invention takes advantage of the comparatively slow diffusion of solid fuel particles relative to the reactant oxidizing gases to simultaneously minimize $NO_x$ formation and maximize $NO_x$ destruction reactions in all phases of solid fuel combustion by increasing the fuel-rich reactive volume both in the near-burner region and throughout the entire furnace. Thereafter, using the derived process methodology, furnace-particular devices are designed to optimize the introduction of solid fuel and combustion air to the furnace, which affects the $NO_x$ emissions. The theory behind such devices and their respective design is the separation of much of the air used in entraining and transporting the solid fuel to the burner through the application of force-related processes in the burner.

Coal is the primary fuel for electric utility boilers. For efficiency, coal requires combustion at 3000° F. or higher. Very extensive coal deposits that contain both sulfur and nitrogen are available in the eastern half of the United States, and the use of this coal for power generation is a major source of $SO_2$ and $NO_x$ pollution in the Eastern United States. $NO_x$ and $SO_2$ are pollutants that lead to smog and acid rain over wide areas far removed from the combustion source, and it is especially a problem in urban environments.

There are two main sources of $NO_x$. One is primarily formed during the combustion of solid coal. The fuel-bound nitrogen whose concentration is generally in the range of 1.0%-1.5%, by weight in the coal, is the primary source of $NO_x$ in coal combustion. Additionally, combustion with air in excess of the amount required for stoichiometric combustion, which is required for all fossil fuels to minimize other pollutants, such as unburned fuel particulate and carbon monoxide, results in the formation of thermal $NO_x$. The thermal $NO_x$ concentration rises substantially at temperatures above about 3000° F.

In addition, and most importantly, the most significant source of oxygen is through the primary air, which is used to transport and inject pulverized coal into furnaces. Recognizing, then, that both secondary and primary air flows directly influence the $NO_x$ emissions in such furnaces, it is an objective of this invention to provide a device which minimizes the mixing of coal with both air flows by the centrifugal separation of pulverized coal from the primary air as it is injected into the furnace through one or more burners. This is achieved by the design and construction of a cyclonic device, as follows.

SUMMARY

The physical process of reducing $NO_x$ emissions is accomplished by providing a device which utilizes centrifugal acceleration of the coal-air mixture to separate the two phases of coal and air. Much of the transport air is then discharged separately in the burner nozzle prior to combustion of the coal in the furnace. The result is the minimization of $NO_x$ emissions. The invention generally comprises a cylindrical burner nozzle; an entry spool at one end of the burner nozzle having a rear wall and defining an inlet port; an inner tube and an outer tube forms the burner nozzle, wherein an annular blade chamber is defined between each said tube; and a blade is formed within the length of the burner nozzle within the blade chamber configured as an extension of the rear wall of the entry spool, said blade twisted to form a spiral around the inner tube. As such, coal particles separated from a primary air stream are collected on the blade to form a coal-concentrated stream which can be concentrated, accelerated, and axially redirected to the furnace while coal-depleted primary air is redistributed over the remainder of the blade chamber to be injected separately.

Thus in a method for minimizing $NO_x$ emissions of a pulverized-fuel-fired furnace, information about a current burner is gathered. Computational models are built for comparing the current burner with a modified burner utilizing modified burner entry and coal nozzle. The geometry of the modified burner is optimized. Then, coal particle density is concentrated at the modified burner by providing a device which uses cyclonic action of tangential entry to the nozzle of the modified burner, wherein the coal particles form a coal-concentrated stream separated from a primary air stream with acceptable pressure drop. This allows the coal-concentrated stream to be redirected to the modified burner while the primary air stream can be injected separately into the modified burner; and, secondary air is allowed to be injected through an unchanged secondary air registry, wherein three separate streams are injected into the furnace, thereby minimizing said $NO_x$ through concentration of solid fuel.

BRIEF DESCRIPTION OF THE DRAWINGS

FIG. 13 shows a top view of the present invention.

FIG. 14 shows a front view of the present invention.

FIG. 15 shows a right side view of the present invention.

DETAILED DESCRIPTION OF THE PREFFERED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated kit assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

Foundation of $NO_x$ Reduction Method

Figure 1:
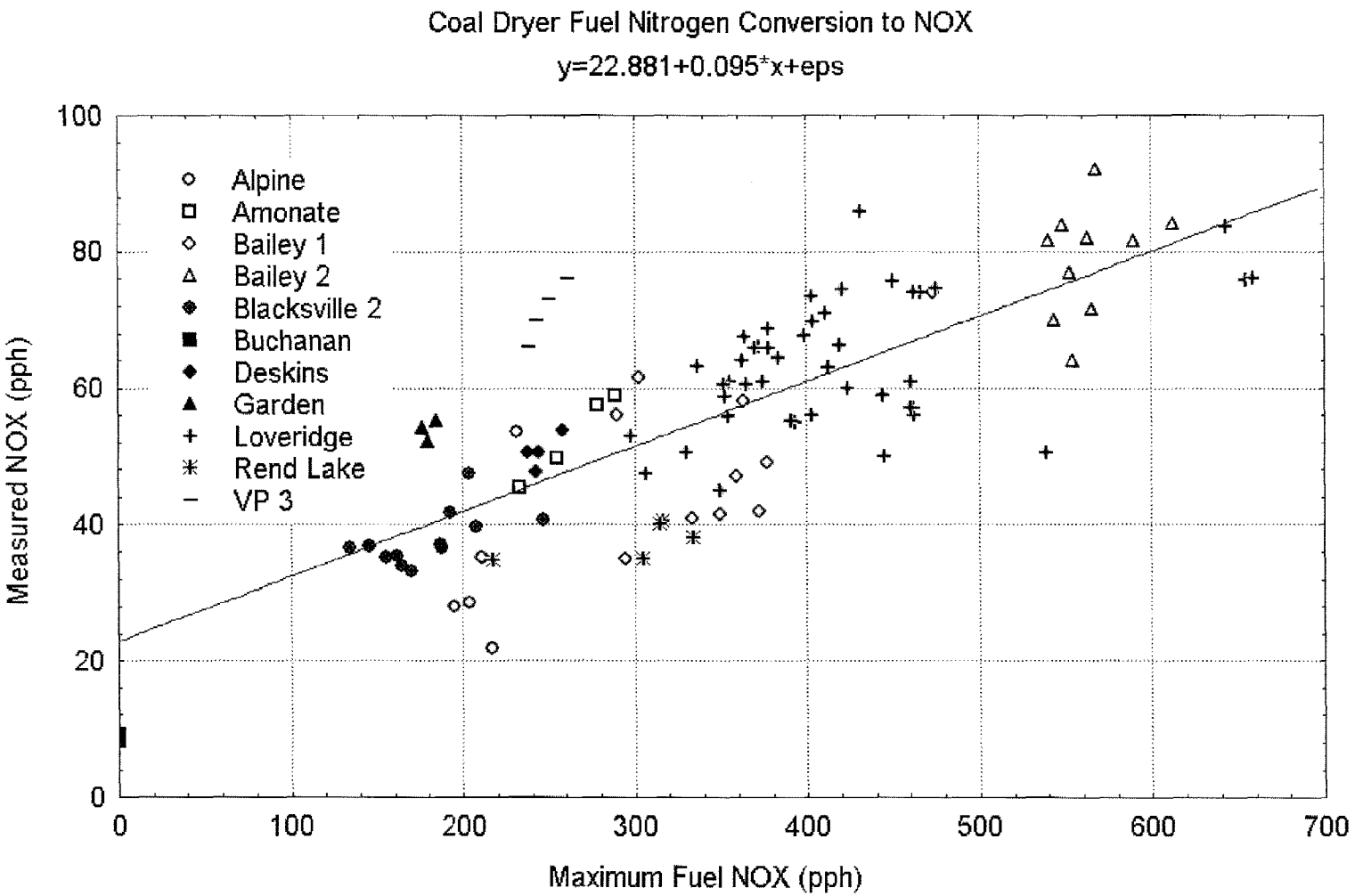
FIG. 1 shows the mass rate of nitrogen oxide emissions from coal-dryer furnaces of similar design.

FIG. 1 shows the mass rate of nitrogen oxide emissions from coal-dryer furnaces of similar design. Ten of these furnaces are fired with coal from the mine which they serve. The Buchanan mine coal dryer is gas fired and hence is not considered in this discussion. Nitrogen oxide emissions are traditionally considered to be a function of coal composition, coal firing rate, and furnace environment. The coal-fired furnaces are of similar design and are operated in a similar fashion. Accordingly, they exhibit a similar furnace environment. The coals fired have varied and distinctive compositions and rank. The firing rates span a broad range representative of the range of furnace sizes. The plot's abscissa combines the firing rate and the nitrogen content of the fuel into a single parameter. Namely, the mass rate of fuel bound nitrogen fired into the furnace converted to nitrogen oxide.

When presented in this fashion it is evident that there is a strong linear relationship between the mass of nitrogen introduced with the fuel and the nitrogen oxide emission from the furnace, irrespective of the coal used. The slope of the curve indicates constant fuel nitrogen conversion efficiency for all the furnaces and coals considered in the data set. The intercept indicates the nitrogen oxides produced by nitrogen fixation from the air (i.e. thermal-NO and prompt-NO), which characterizes a feature of the design of these furnaces. The data has a constant standard deviation from the trend line of 10 pph and this constancy is due to factors that are firing rate independent such as measurement error, or fluctuations in air flow.

The question of how furnace design affects conversion efficiency is addressed in a pilot-scale furnace study, which varied independently furnace stoichiometry and residence time. This is accommodated by changing the firing rate, the quantity of air fed to an over-fire air manifold, and the elevation difference between the burners and the over-fire air manifold. The results of this study may be viewed on FIG. 2.

The data set is uniformly distributed over an extensive range of firing rates and stoichiometries. No effect of residence time per se is evident, and all the effect is accounted by the fuel-air ratio below the over-fire air and the mass rate of fuel-bound nitrogen.

Figure 2:
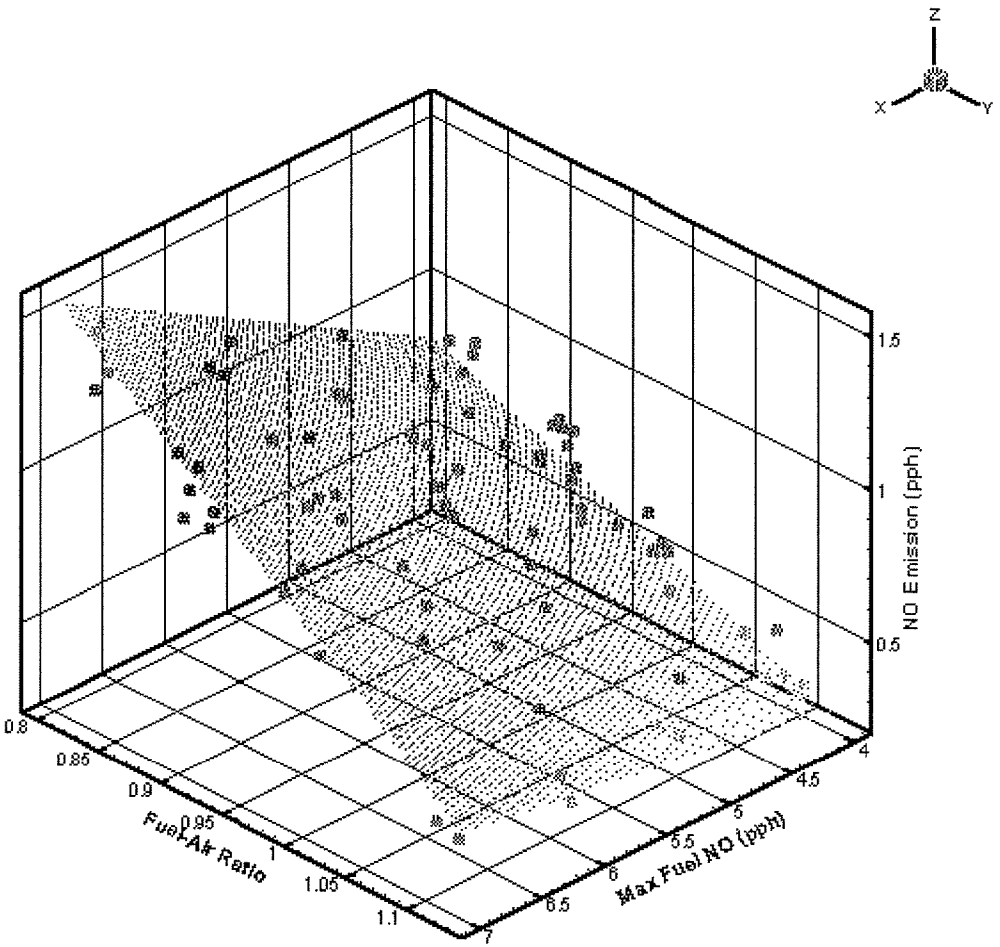
FIG. 2 shows results of a study about how furnace design affects conversion efficiency.
Figure 3:
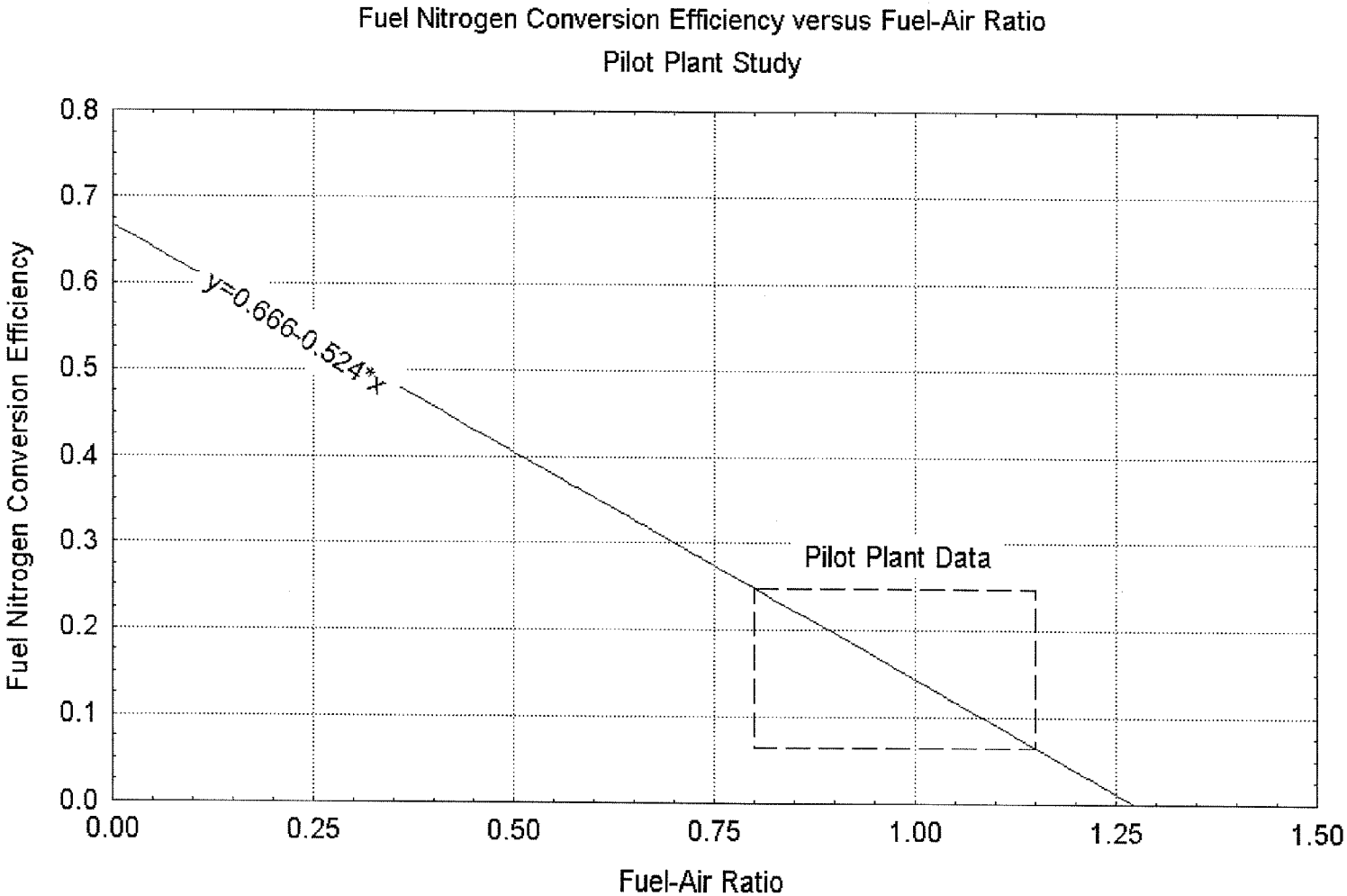
FIG. 3 shows the linear trend derived when the data in FIG. 2 is converted to fuel-bound nitrogen conversion efficiency.

FIG. 3 shows the linear trend derived when the data in FIG. 2 is converted to fuel-bound nitrogen conversion efficiency.

The data has a constant standard deviation from the trend line less than 0.02, which is a measure of experimental error. The meaning of the fuel-air ratio dependence is not apparent from this data. It suggests that stoichiometry alone controls the process, but later computer modeling revealed the correct interpretation.

Figure 4:
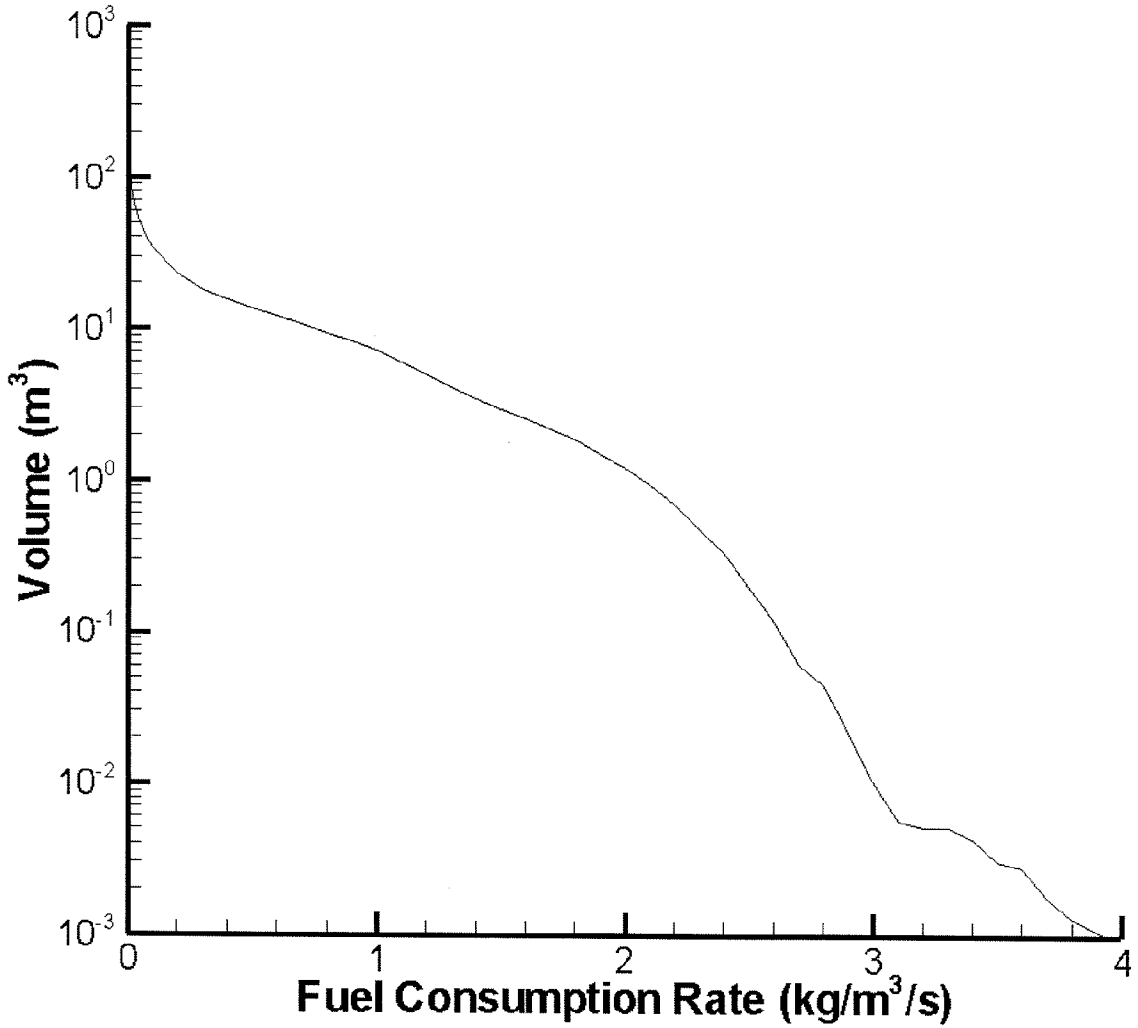
FIG. 4 shows a plot of the volume of a furnace classified as a function of the volumetric rate of fuel consumption.

The computational study was completed for a 370 MW coal-fired unit at an electric utility power generation station. The reactive volume of a coal introduced into a furnace through a burner consists of several stages. These are evident when the volume of a furnace is classified by the volumetric rate of fuel consumption as shown in FIG. 4. The plot presents the volume of the furnace having a fuel consumption rate greater than the value on the abscissa. The plot has three distinct stages: ignition, attached flame and char burnout.

Ignition is characterized by the high rates of energy release necessary to achieve a stable flame and is distinguished by the discontinuity in the plot for a fuel consumption rate slightly above 3. The attached flame occupies the volume having fuel consumption rates between the aforementioned discontinuity and the inflexion point in the plot at a fuel consumption rate slightly below 1. Char burnout uses the residual volume from inflexion point to intercept of the coordinate axis.

The case depicted in FIG. 4 is for a 24 burner, opposed-wall coal-fired boiler having a total furnace volume of 5020 $m^3$. The total reactive volume (coordinate intercept) is 890 $m^3$ or 18% of the furnace volume. Typically the reactive volume occupies 15% to 25% of the furnace volume. The reactive volume can be further classified as fuel rich and fuel lean.

Figure 5:
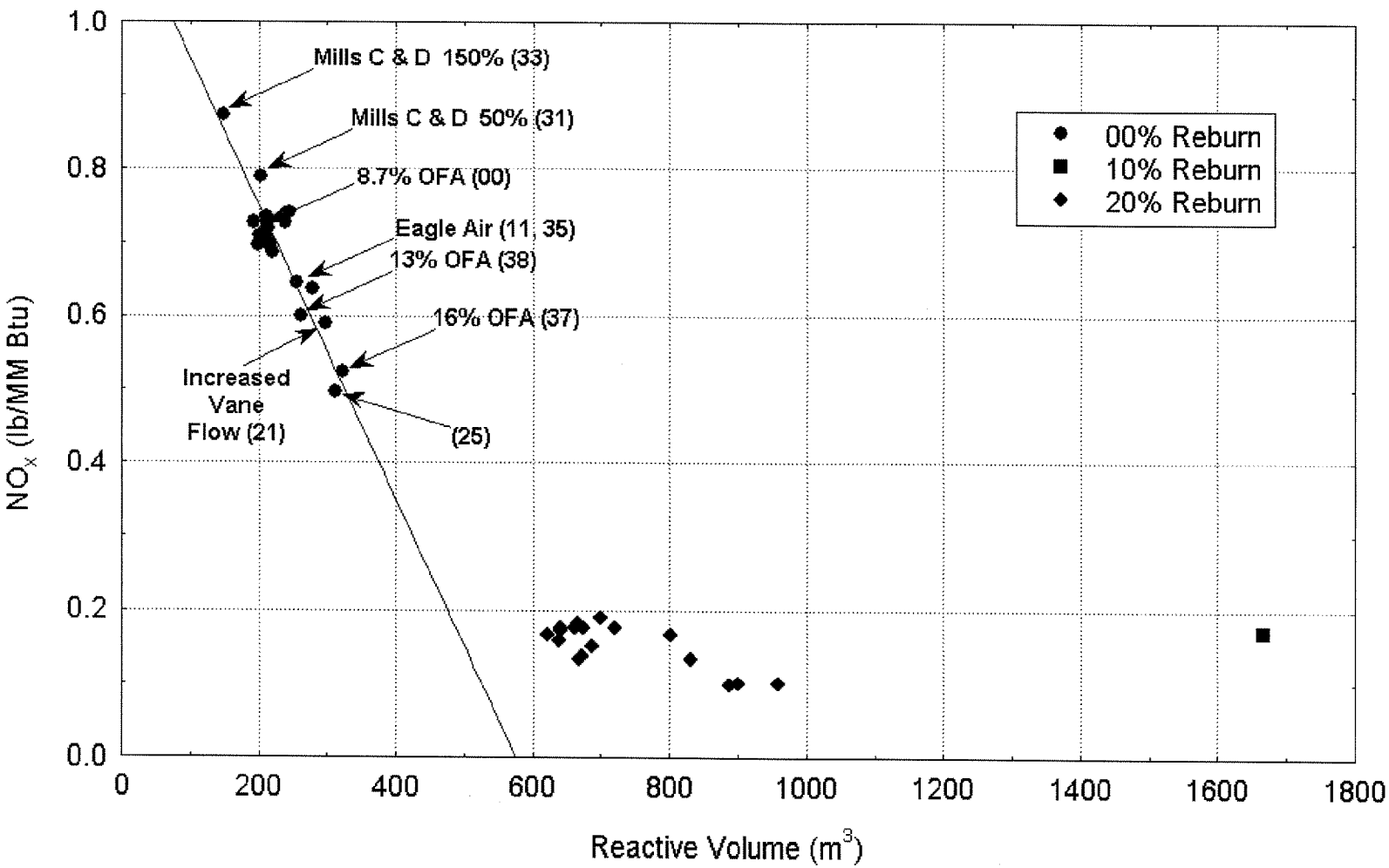
FIG. 5 shows the nitrogen oxide emissions as a function of fuel-rich volume.

FIG. 5 shows the nitrogen oxide emissions as a function of fuel-rich volume. (Only the filled circle data points without gas reburn are pertinent.) The case designated 00 corresponds to that used for the discussion of reactive volume. The relationship between nitrogen oxide emissions and furnace configuration is determined to be a linear response to fuel-rich reactive volume. This trend is in agreement with actual furnace performance for the configurations considered in cases 00, 37, and 38.

Case 25 is a simple modification of case 00, in which the coal through the burner is constrained to a single quadrant of the coal pipe instead of the entire pipe cross-section. The response is strong and continued concentration of the coal increases the effect. The premise for this behavior is that the rate of reaction is slowed, and hence the reactive volume is increased, by retarding the micro-scale mixing of oxidant and fuel. The micro-scale mixing of a fuel in particulate form is limited by the particle diffusivity which is inversely proportional to the particle radius and the viscosity of the oxidizing fluid in which it is suspended. Pulverized coal suspended in air is an example of large (greater than 10 micrometers) particles in a low viscosity fluid. By concentrating the particle density at the burner, the reactive volume is effectively increased, and the nitrogen oxide emission consequently reduced.

Support for the validity of this approach was gained from a perturbation study performed on the same 370 MW electric utility coal-fired furnace. The field test required that the concentration of coal fed to the furnace be cycled by ±5% from its set-point value. The result was that concentration of the coal flow exhibited nitrogen oxide reduction greater than that achievable with secondary air perturbation.

FIGS. 6, 7, 8, and 9 compare case 00 (LHS) and case 25 (RHS).

Figure 6:
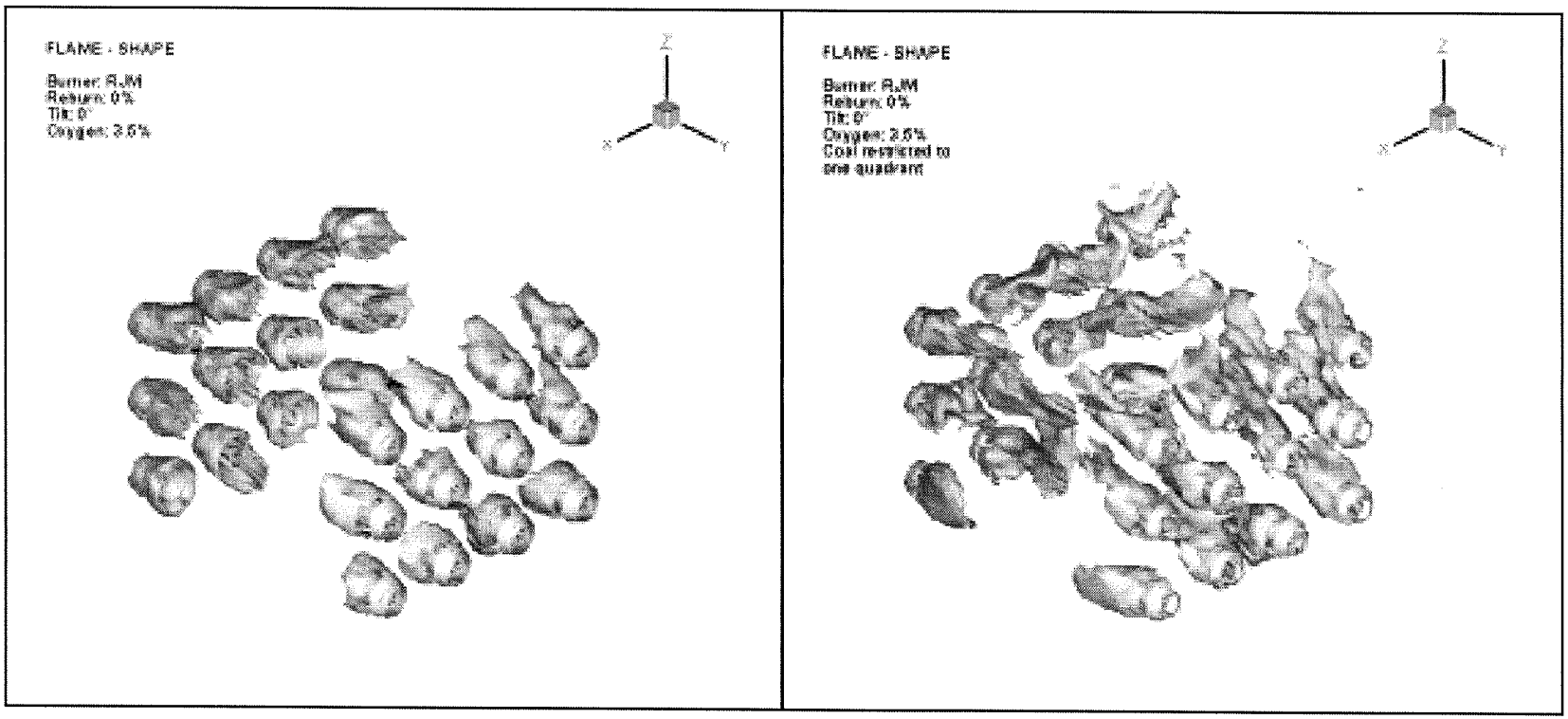
FIG. 6 is a model depiction of the shape of a burner-attached flame.

FIG. 6 compares the burner-attached flame. The volume for both exhibits is comparable at about 10 $m^3$. The shape of the RHS flames is less regular as expected from a skewed coal distribution.

Figure 7:
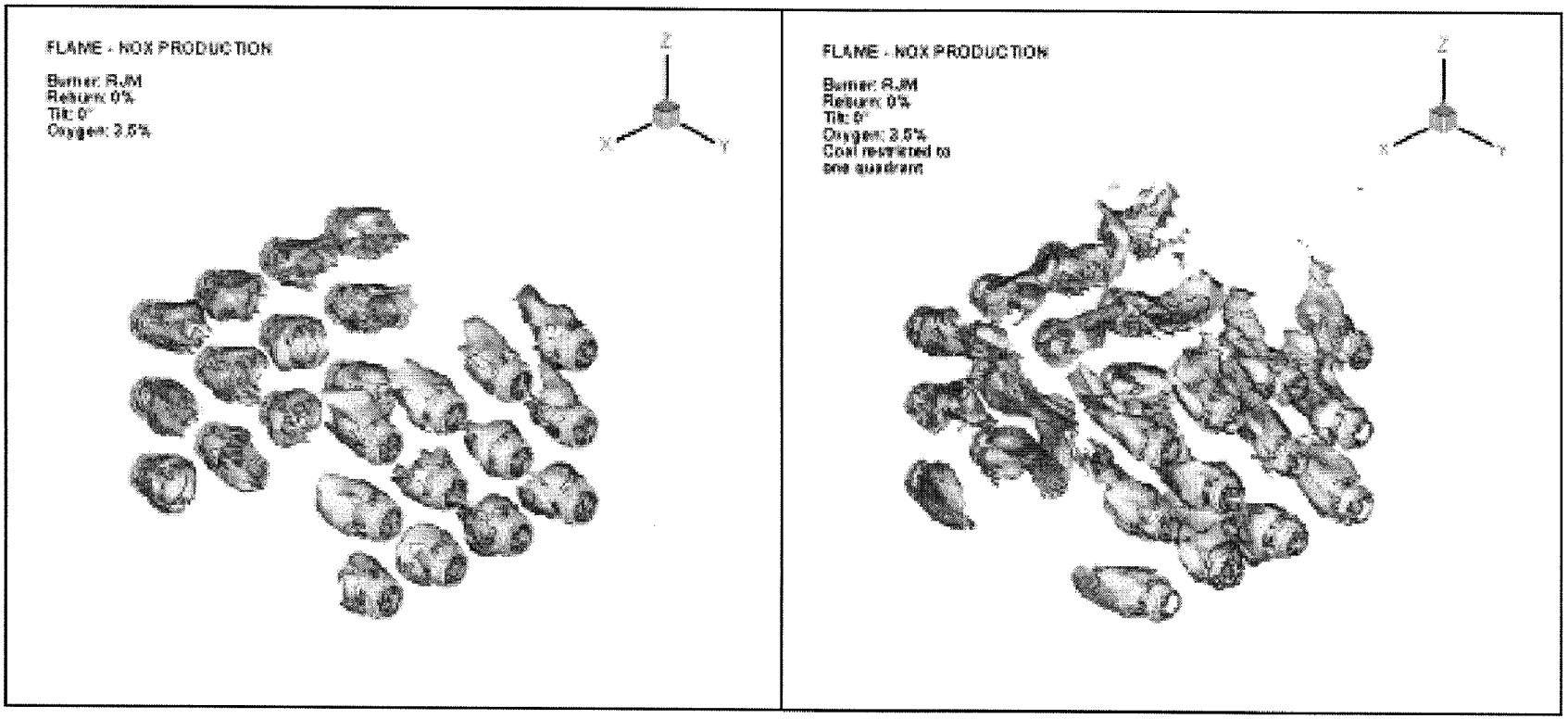
FIG. 7 shows the same flames as FIG. 6 with the addition of superimposed nitrogen oxide generation contours.

FIG. 7 shows the same flames as FIG. 3 with the addition of superimposed nitrogen oxide generation contours. Contours are color coded, blue to red, 0 to maximum. Nitrogen oxide formation is found predominantly on an annulus surrounding the burner, near to the furnace wall. The concentrated coal flow has clearly inhibited the generation of nitrogen oxide.

Figure 8:
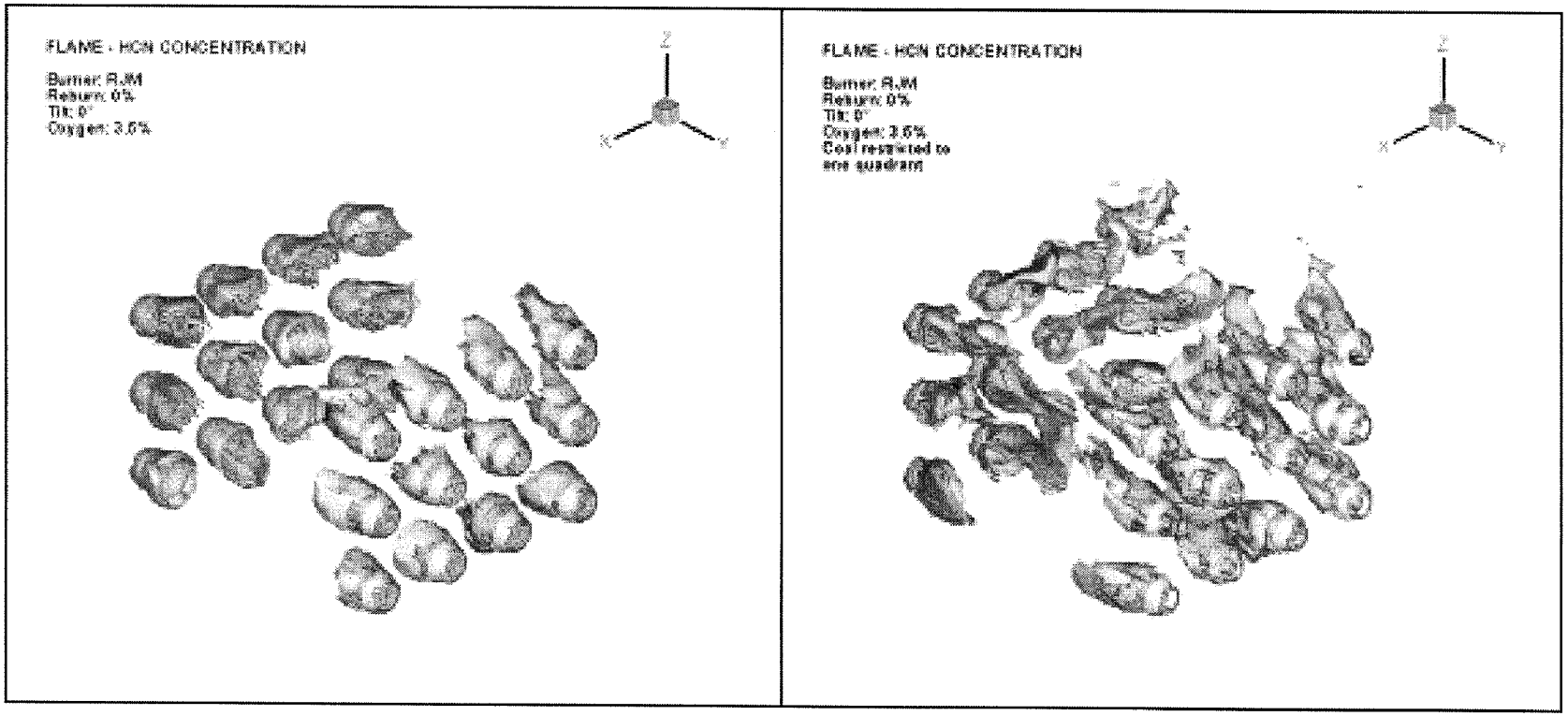
FIG. 8 shows the same flames as FIG. 6 with the addition of superimposed hydrogen cyanide concentration contours.

FIG. 8 shows the same flames as FIG. 3 with the addition of superimposed hydrogen cyanide (HCN) concentration contours. Contours are color coded, blue to red, 0 to maximum. The HCN is an important intermediate for the formation and reduction of nitrogen oxides. In a fuel-rich environment, the HCN will reduce any nitrogen oxide it encounters to molecular nitrogen. The concentrated coal flow exhibits strong nitrogen oxide reducing conditions in the burner zone.

Figure 9:
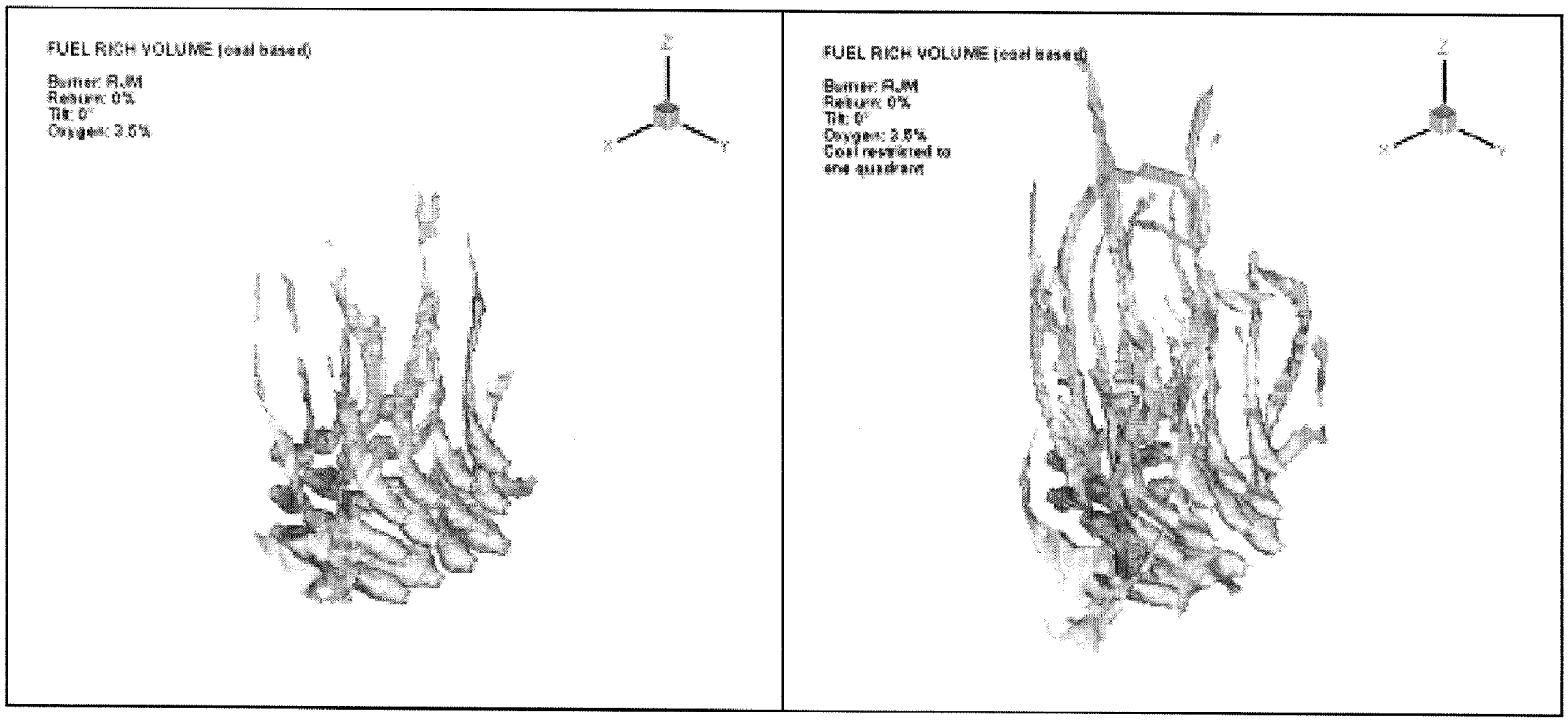
FIG. 9 shows the fuel-rich reactive volume as a determiner of the ultimate nitrogen oxide emission.
Figure 10:
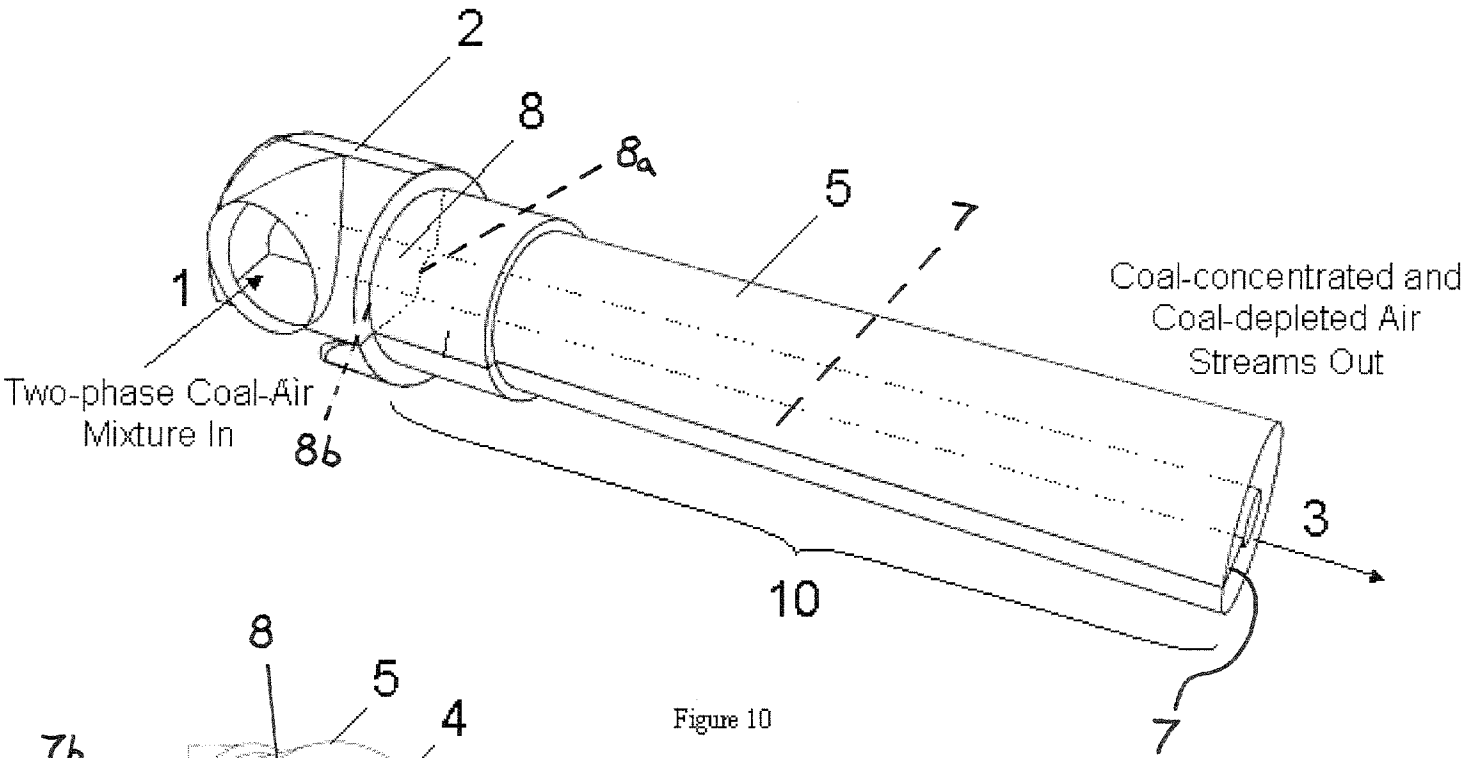
FIGS. 10-12 show perspective views of the present invention.

FIG. 9 shows the fuel-rich reactive volume. This volume is the determiner of the ultimate nitrogen oxide emission. The LHS volume is 200 $m^3$ whereas the RHS volume is 300 $m^3$. It is this volume which inhibits the conversion to nitrogen oxide of both the fuel nitrogen released in the burner and that released from the char. The concentrated coal flow case again has superior characteristics for nitrogen oxide reduction.

Device for Application of $NO_x$ Reduction Method

Recognizing, then, that both secondary and primary air flows directly influence the $NO_x$ emissions in such furnaces, it is an objective of this invention to provide a device which minimizes mixing of coal with both air flows by the centrifugal separation of pulverized coal from the primary air as it is injected into the furnace through one or more burners. This is achieved by the design and construction of a cyclonic device, as follows.

The method of effecting the concentration of particles in a fluid stream is accomplished by application of body forces to the particulate phase. These forces may be electrical, magnetic, mechanical, fluid dynamic, or depending upon the material properties of the particle and the suspending fluid, any property which allows a significant differential in force to be applied to the particle relative to the suspending fluid. The method is applicable to any pulverized-fuel-fired burner for all suspension-firing system designs, including both wall-fired and tangentially-fired furnaces.

FIGS. 10-16 show the specific device, which uses the cyclonic action of tangential entry to the fuel nozzle of a coal burner to accomplish particle segregation with acceptable pressure drop and minimal remixing of the particulate phase. The profile for the entry turns with minimal mixing and maximum concentration of particulate, producing a flow collinear with the axis of the burner. Even in a straight through entry, the segregation may be affected by swirl vanes in the duct and a skimmer plate to collect and deliver the concentrated fuel flow to the nozzle. In any design the concentrated fuel stream may be physically separated from the rejected carrier fluid or not, so long as the concentrated flow does not re-disperse prior to delivery at the burner nozzle.

In implementing such a device, current burner information for the facility is first inspected and gathered. This information includes coal pipe size and configuration relative to burner entry, coal flow, burner entry details, coal nozzle and igniter details, space constraints external to the furnace, burner servicing equipment, etc. Computational models are then built for the existing and modified burner entry and coal nozzle. Multiple cases are run to optimize burner modification geometry to obtain the desired coal and primary air distribution at the nozzle exit.

With reference then to FIGS. 10-16, which shows one embodiment of the present invention, the device is inserted into the existing burner opening in the secondary air windbox. The top and front views displayed in FIGS. 13 and 14 show the orientation of the device relative to the furnace. The left end is fastened to the boiler casing and corresponds to the burner entry, and the right end is supported inside the secondary air register opening in the furnace wall and corresponds to the burner nozzle where fuel and primary air are injected into the furnace.

The two-phase coal-primary air mixture enters at the inlet port 1, which provides an opening or entryway into the entry spool 2. The direction of flow into the entry spool 2 is tangent to the burner axis. The purpose of the tangential entry is to impart a rotation to concentrate and separate the medium and coarse coal particles from the coal/primary air mixture 164. The centrifugal body force is used to separate the coal from the primary air and concentrate it along a blade 7 that is an extension of the rear wall of the entry spool 2, as follows. The coal-concentrated stream 160 and coal-depleted primary air stream 162 are injected separately into the furnace through exit port 3.

The device is made up of the entry spool 2 and the burner nozzle 10. The burner nozzle 10 is formed generally by two concentric steel tubes. The inner tube 4 supports the penetration of the burner igniter through exit port 3. The outer tube 5 is the burner nozzle annular outer perimeter, which separates the flow of coal and primary air from the secondary air register. The annulus between the two tubes forms blade chamber 6.

Figure 11:
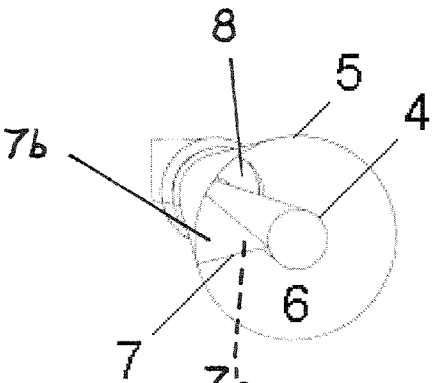
Figure 12:
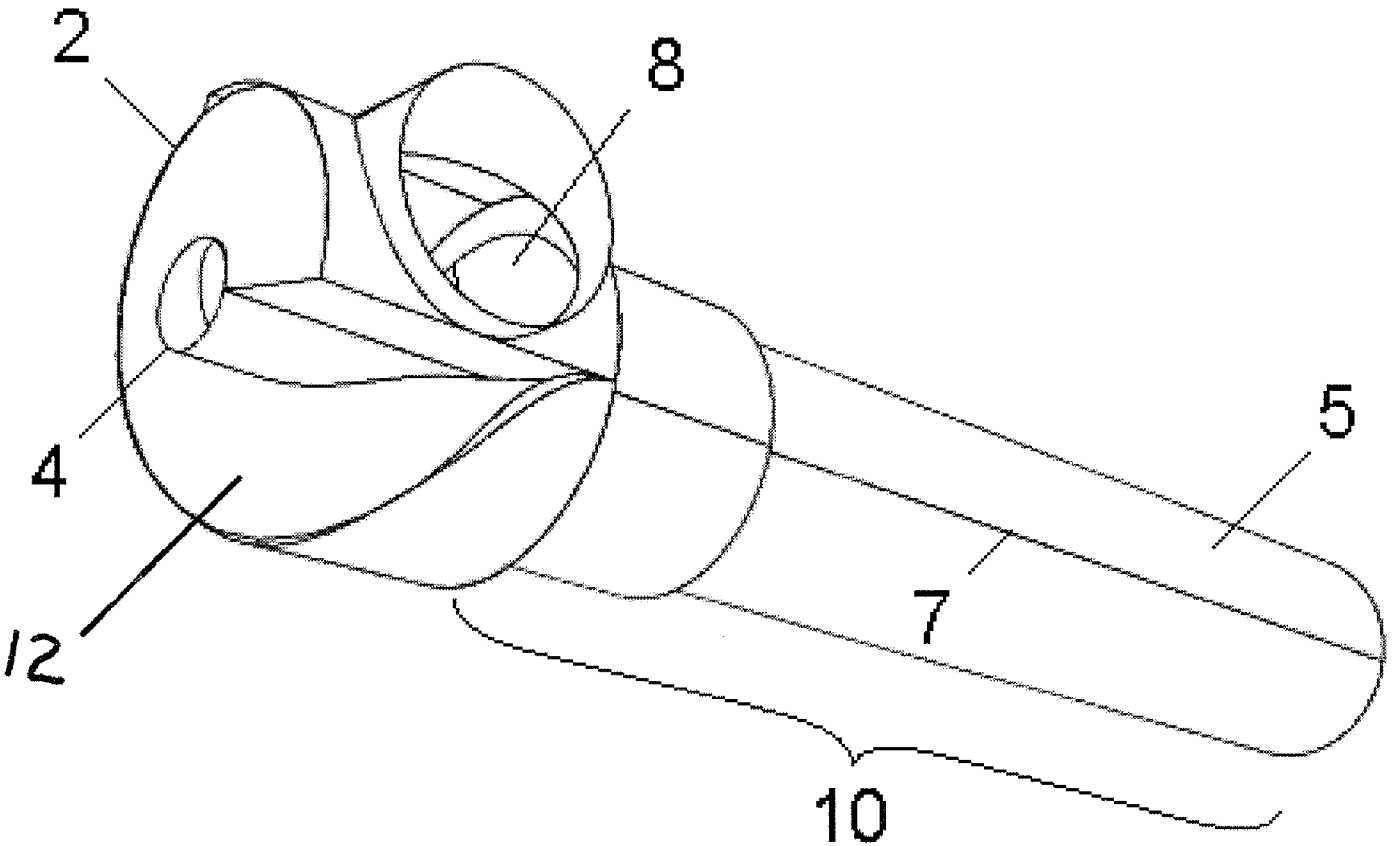
Figure 16:
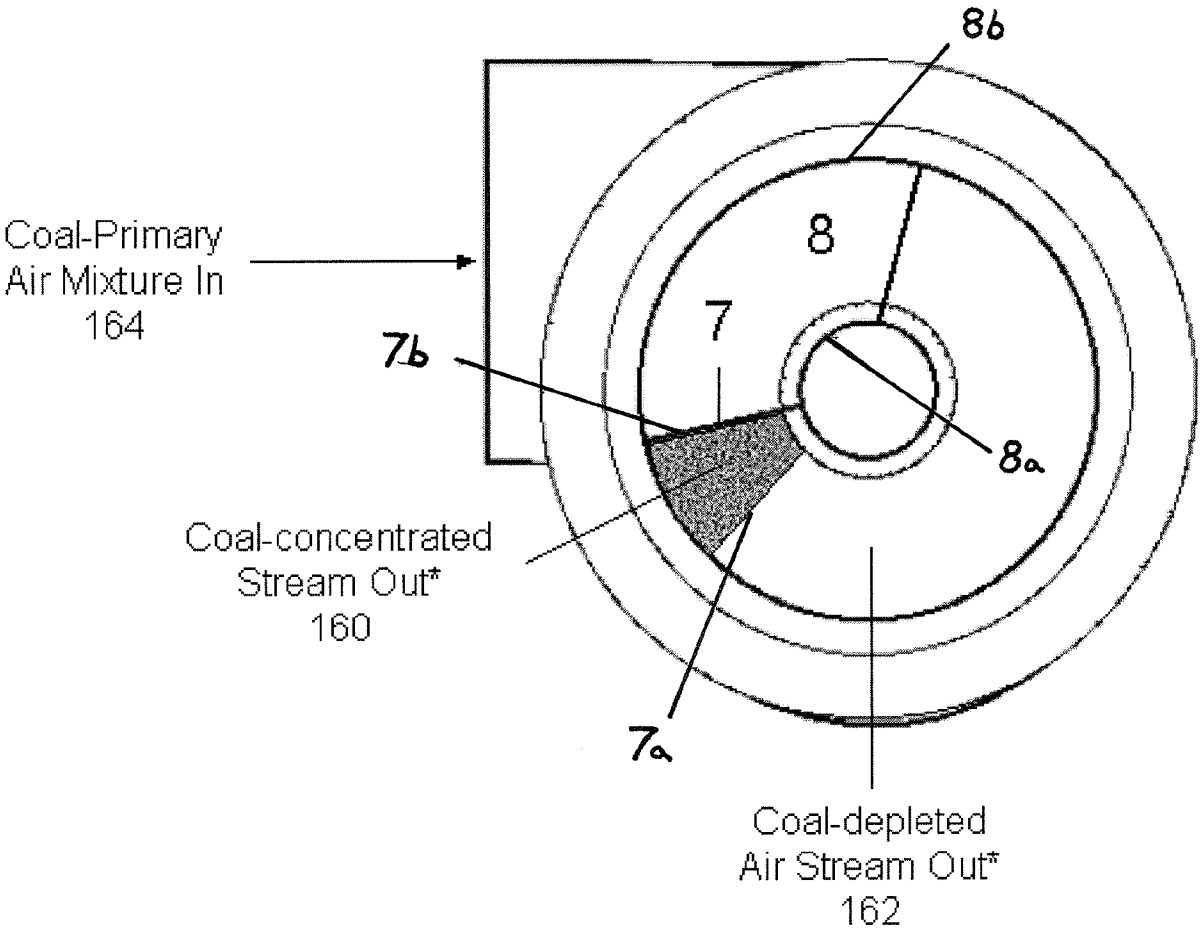
FIG. 16 shows an end view of the present invention illustrating the coal and primary air streams entering the furnace.

FIGS. 11 and 12 show two perspective views that illustrate the development of the blade 7 through blade chamber 6. The blade 7, having a top 7*a* and bottom 7*b*, is formed from the rear wall or back plate 12 of the entry spool 2 by twisting the back plate 12 to form a spiral around the inner tube 4, and extending it down the axis uncoiled over the full length of the burner nozzle 10 on one side of the inner tube 4. The entry spool 2 back plate 12 shape is used to accelerate and redirect the flow axially along the annulus of the burner nozzle 10. The function of the blade 7 is to collect the coal particles separated from the primary air stream, and to concentrate, accelerate, axially redirect and convey the coal-concentrated stream 160 to the furnace. The blade 7 further acts as a collector for the coal and also reduces the amount of rotation in the flow at the burner exit port 3. This function is accomplished by this design with minimum pressure drop and reentrainment of the coal in the coal-depleted primary air stream 162. The coal-depleted primary air 162 redistributes over the remainder of the blade chamber 6 cross-section not occupied by the concentrated high-density coal stream, and is injected separately along the burner axis with minimum rotation. This modified burner design differs from other low-NOx burners for firing pulverized coal in that it effectively injects three separate streams into the furnace. In particular, figure 16 shows that the coal-concentrated stream 160 and coal-depleted primary air stream 162 are injected axially as two separate streams through the exit port 3. The coal-concentrated stream 160 is immediately adjacent to the blade 7. The density of the coal-concentrated stream 160 is determined by the burner entry or entry spool 2 design, i.e., the tightness of the arc in the back plate 12 of the entry spool 2, the sharpness of the angle on which the back plate 12 transitions to form the blade 7, and the ultimate radial position of the blade 7 in the blade chamber 6. The secondary air is injected with swirl through the unchanged secondary air register surrounding the burner nozzle exit port 3.

A deflector plate 8 is positioned abutting the bottom of the blade 7. The deflector plate has a radial inner tube surface 8*a* disposed against the inner tube 4 and a radial outer tube surface 8*b* concentric with the inner tube surface 8*a* disposed against the outer tube 5. The function of the deflector 8 is to prevent expansion of the entering coal and primary air jet along the burner axis under the blade before the flow rotation is established in the entry spool. The deflector 8 is a plate that runs adjacent to the spool entry 2 on the furnace side and obstructs varying portions of the annular cross section. The percentage of obstructed cross section within the burner nozzle 10 may vary, as below.

Figure 17:
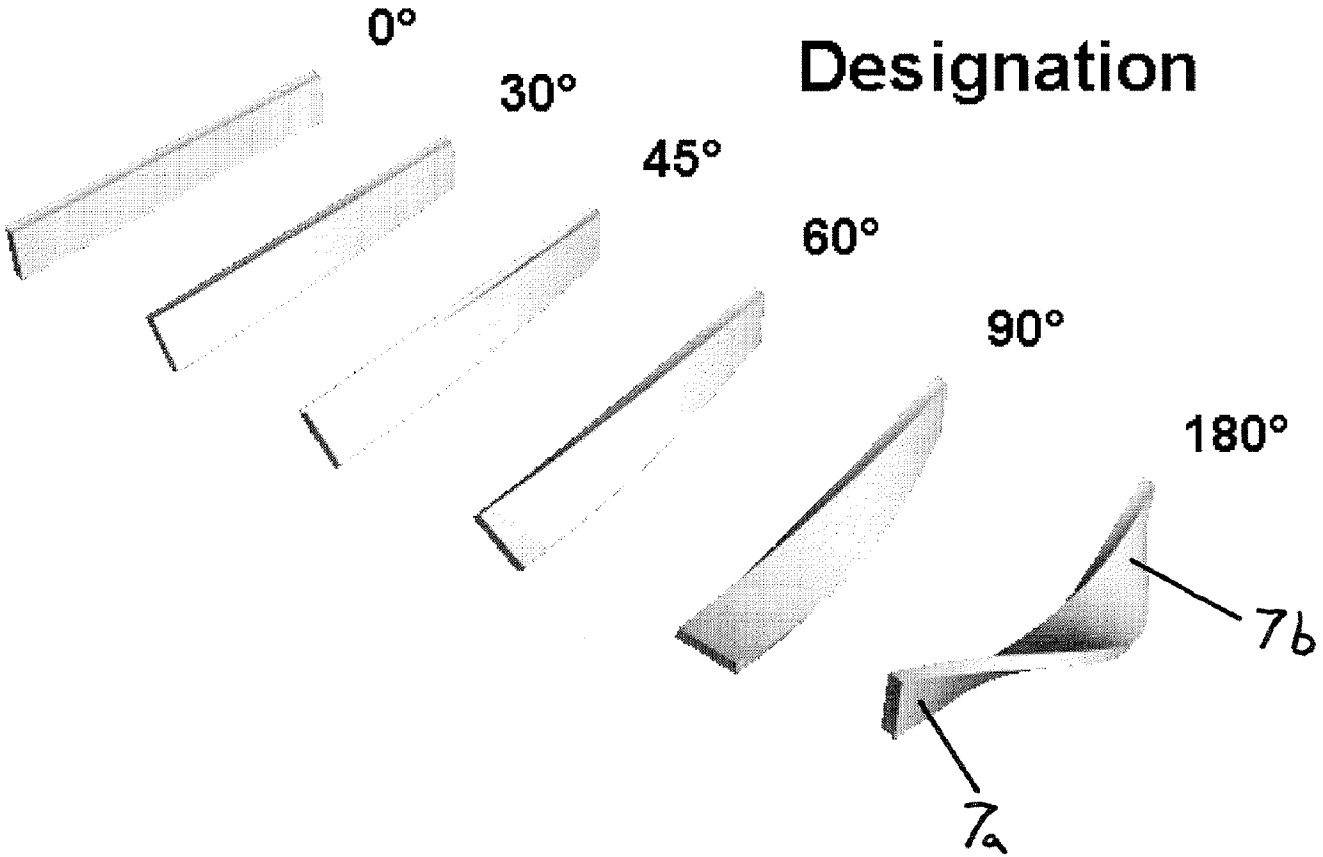
FIG. 17 shows different embodiments for the design of the blade.
Figure 18:
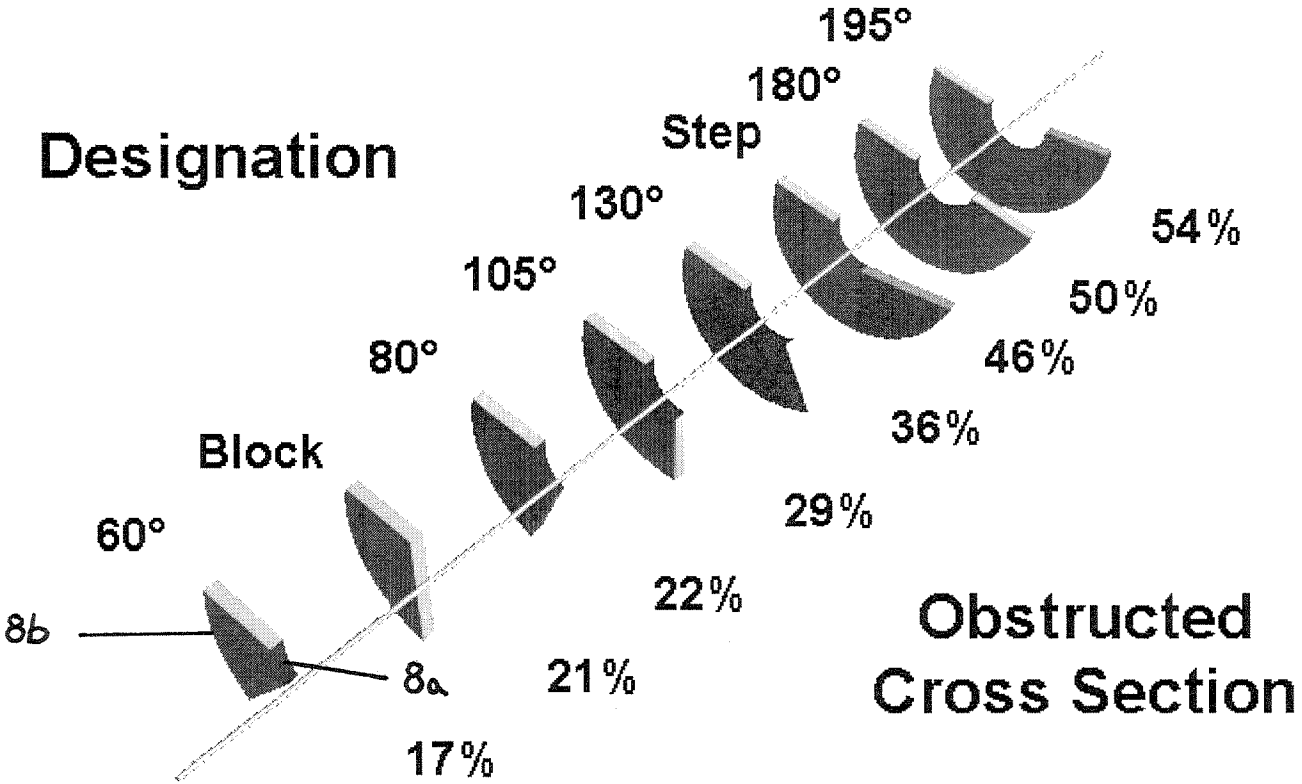
FIG. 18 shows different embodiments for the design of the deflector.
Figure 19:
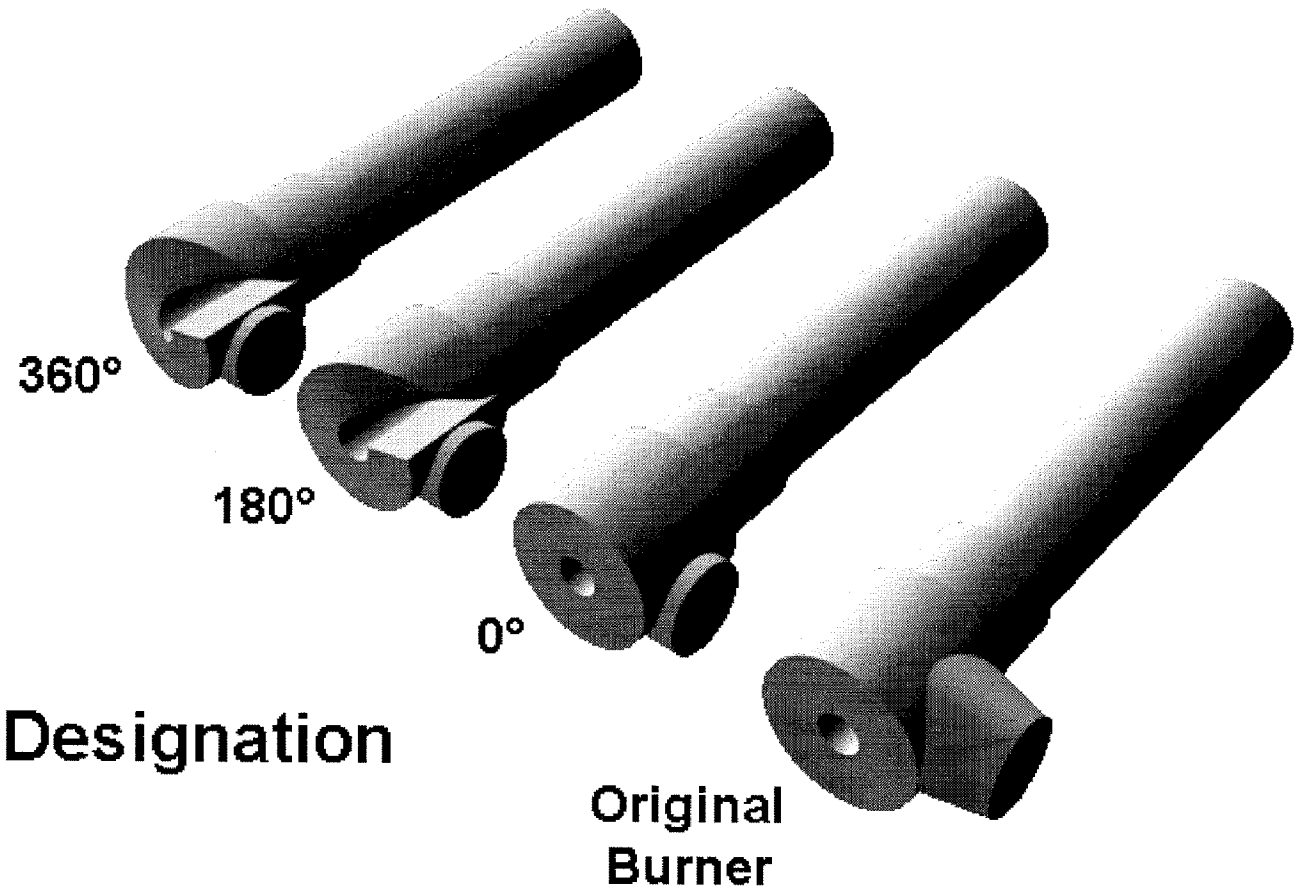
FIG. 19 shows different embodiments for the design of the entry spool.

With reference to FIGS. 17-19, the particular design, tightness, and angles, etc. of the blade 7, deflector 8, and entry spool 2 structural components will likely vary from furnace to furnace. The specific device is optimized according to the existing fuel delivery system and nozzle configurations. The design of the specific device is mainly constrained by the existing fuel delivery system pressure drop requirements, and the available space at the location of the main (secondary air) windbox penetration by the fuel nozzle.

As it pertains to the blade 7, the blade 7 is a key design component for capturing and further concentrating the particles in a single stream. The blade 7 runs the entire length of the annular burner nozzle 10 within blade chamber 6 (although it may be recessed at the burner exit to avoid thermal damage), and bridges across the gap in the blade chamber 6, i.e. between the ignitor inner tube 4 and outer tube 5/nozzle annulus perimeter. Blade designation refers to the amount of twist in the blade 7 from 0°, a flat blade, to 180°, which refers to a blade at the annular nozzle entry is twisted 180° such that the top edge of the blade at entry becomes the bottom edge at the exit port 3. Each angle displays differing degrees of coal particle capture and concentration on the blade 7 and the angle may vary depending on the furnace in which it is implemented because of the amount of variable present. See FIG. 17 for example.

In one particular study it was determined that a blade 7 having an angle of 60° gave the best single stream concentration of coal particles. For lesser twist in the blade 7 (0°, 30° and 45°), higher-than-average concentration areas may form along the blade 7, but these areas do not concentrate into a distinct single high-concentration area and a significant number of medium to coarse coal particles rebound off the blade and spill over into the region under the blade. For greater twist, the high-than-average concentration areas are spread out more along the boundary compared to the 60°-blade case because the coal particles do not possess a sufficient rotational velocity component to reach the blade and concentrate on the blade before the exit of the nozzle.

With reference to FIG. 18, a variety of deflector 8 designs had been investigated. The numerical designation for the deflector 8 refers to the angle downward relative to the radius formed by the top of the blade, or the number of degrees on a 360° circle that are obstructed below the blade. For example, the 60° deflector obstructs one-sixth, or 17% of the cross section below the blade. The Block designation refers to an obstructed area under the blade that spans between the bottom of the blade and a 90° tangent (relative to the line defined by the bottom of the blade) to that point on the ignitor tube. The Step designation refers to an obstructed area that spans between the bottom of the blade and a horizontal tangent to the bottom of the inner ignitor tube.

Of the three key design features (entry spool 2, deflector 8 and blade 7), the pressure drop through the burner is most sensitive to the size of the deflector 8 obstructed cross section. For the 60° deflector, the pressure drop through the burner is roughly 350 pascals (Pa) or approximately 1.4 inches of water. The pressure drop increases as the obstructed area for the deflector 8 increases, attaining roughly 550 Pa (2.2" WC) for the 130° deflector (36% deflector obstructed cross section), and 820 Pa (3.3" WC) for the 180° deflector (50% deflector obstructed cross section). A deflector with smaller obstructed area is recommended to minimize both coal layout and burner pressure drop. The size must be matched to the entry and blade designs to give the necessary coal separation and concentration effect.

With reference to FIG. 19, multiple entry spool designs are shown. The main function of the entry spool 2 is to provide a cylindrical chamber for separating the coal particles from the primary air through the cyclonic action instigated by the tangential entry. Once this separation occurs in the entry spool 2, it is desirable to both concentrate the separated coal particles on top of the blade and neutralize the rotation before injection of the coal and primary air into the furnace. The entry spool may be designed to initiate these two processes by gradually imparting an axial flow component directed onto the top of the blade through the shape of the back plate. The designation 0° refers to a flat back plate. The designation 180° refers to a back plate that includes a helical twist that is initiated one-half way around the circle relative to the top of the blade. The designation 360° refers to a back plate where the twist begins at the top of the blade at the entry.

For one particular study, it was determined that progressively changing the entry spool from 0° to 360° does not improve the concentration of the coal particles on top of the blade. In fact, the response for the change to the 180° entry spool is to inhibit concentration of the coal particles on the blade relative to the 0°-entry spool case, and direct the coal particles to the wall of the annulus. For further transition to the 360°-entry spool, the response is greater concentration of the coal particles in an area that is migrating back on to the plate relative to the 180°-entry spool case. For only this one type of furnace it was evident the back plate modification was unnecessary due to a relatively small diameter of entry spool. The force of rotation was sufficient to separate and concentrate the coal particles on the top of the blade without shaping the back plate. In other instances where the burner entry spool is larger in diameter, there would likely be some angular modification to the entry spool.

It should be understood that the specific design of the device is calculated to separate the bulk of the coal from the coal/primary air mixture and inject it as a single coal-concentrated stream into the furnace. It should maintain the distribution of the fine particles in the primary air stream to give acceptable burner ignition and stability characteristics. The density differences between the coal-concentrated stream and the coal-depleted primary air should result in a distribution of axial velocities at the burner exit. The design should give minimal rotation in the coal particle and primary air exit flows. It should minimize internal flow recirculations to prevent coal layout. The design should accomplish these objectives with minimal change in pressure drop through the burner. Thus, the key components of the device and burner modification design to accomplish the desired coal and primary air distribution include tangential or swirl vane entry, the entry spool, deflector, and the blade. Accordingly, each component must be analyzed for each furnace with the design of the structural components varying to be specifically adapted for that particular furnace so that coal entry conditions can be optimized, and therefore coal-air proportions entering the furnace are optimized as a result to minimize $NO_x$ emissions.

We claim:

1. An apparatus for minimizing $NO_x$ emissions of a pulverized-fuel-fired furnace, comprising:

a burner nozzle having two ends and an outer tube forming a perimeter of said burner nozzle;

an entry spool having a back plate and defining an inlet port at one of said ends of said burner nozzle, said back plate helically twisted entirely within said entry spool;

an inner tube formed within said burner nozzle;

an annular blade chamber defined between said outer tube and said inner tube; and, a blade formed within said blade chamber configured as an extension of said back plate of said entry spool, said blade uncoiled and extending down said burner nozzle the full length of said burner nozzle attached to and coaxial to said inner tube and on one side of said inner tube, wherein fuel particles can be separated from a primary air stream within said entry spool and collected on said blade with minimized rotation to form a coal-concentrated stream for entry into said furnace.

2. The apparatus of claim 1, wherein one of said ends is adapted to be fastened to a boiler easing to correspond to a burner entry.

3. The apparatus of claim 1, wherein one of said ends is adapted to be supported inside a secondary air register opening in a furnace wall.

4. The apparatus of claim 1, further comprising a deflector plate running adjacent to said entry spool abutting a bottom of said blade positioned to obstruct a cross-section of said blade chamber.

5. The apparatus of claim 4, wherein said deflector plate is positioned to obstruct in the range of 17% to 54% of said cross-section of said blade chamber.

6. The apparatus of claim 1, wherein said blade is twisted with a blade designation in the range of 0°-180°.

7. The apparatus of claim 1, wherein said back plate of said entry spool is twisted up to 360°.

8. The apparatus of claim 1, further comprising an exit port defined by an end of said inner tube, wherein said inner tube is adapted to support penetration of a burner igniter through said exit port.

* * * * *